US005612161A

United States Patent [19]

Watanabe et al.

[11] Patent Number: 5,612,161

[45] Date of Patent: Mar. 18, 1997

[54] NEGATIVELY CHARGABLE TONER FOR ELECTROPHOTOGRAPHY

[75] Inventors: Masao Watanabe, Meguro-Ku; Kozo Suzuki, Nagareyama; Hikoji Ueda, Fujimi, all of Japan

[73] Assignee: Fujikura Kasei Co., Ltd., Japan

[21] Appl. No.: 580,056

[22] Filed: Dec. 20, 1995

[30] Foreign Application Priority Data

Dec. 20, 1994 [JP] Japan ..... 6-334617

[51] Int. Cl.[6] ..... G03G 9/097

[52] U.S. Cl. ..... 430/110

[58] Field of Search ..... 430/110, 115

[56] References Cited

U.S. PATENT DOCUMENTS 4,994,341 2/1991 Adair et al. ..... 430/115

5,374,495 12/1994 Ata et al. ..... 430/110

5,411,833 5/1995 Swidler ..... 430/115

*Primary Examiner*—John Goodrow

*Attorney, Agent, or Firm*—Wenderoth, Lind & Ponack

[57] ABSTRACT

A negatively chargable toner for electrophotography, comprising a binder, a coloring agent and a charge control agent, the charge control agent comprising a copolymer of 1 to 30% by weight of a sulfoalkyl (meth)acrylic acid monomer represented by a specific chemical formula and 99 to 70% by weight of other vinyl monomer copolymerizable therewith, the amount of the charge control agent being from 0.1 to 10 parts by weight for 100 parts by weight of the binder. The toner can be charged immediately, can stably maintain the toner properties, in particular, under the conditions of high temperatures and high humidities, can produce a good image that is free from toner scattering, fogging and the like, and can be made into a color toner capable of clearly forming a colored image.

4 Claims, No Drawings

NEGATIVELY CHARGABLE TONER FOR ELECTROPHOTOGRAPHY

BACKGROUND OF THE INVENTION

The present invention relates to a negatively chargable toner for electrophotography to be charged negatively, which is used for converting an electrostatic latent image into a visible one in a dry electrophotographic process.

Toner particles used for converting an electrostatic latent image into a visible one in a dry electrophotographic process are produced by premixing, in general, a binder, a coloring agent and a charge control agent, with, when necessary, a magnetic powder and some other additives added thereto, and subjecting the mixture to melt kneading, grinding and then classification to obtain particles with a desired particle diameter. In the case where such a toner is used as a two-component developer, the toner particles are mixed with a magnetic powder with stirring. Charge is accumulated on the surfaces of the toner particles due to friction between the toner particles.

On the other hand, when the toner is used as a single-component developer, charge is accumulated on the surfaces of the toner particles due to friction between the toner particles and a sleeve or the like. The charge thus accumulated is utilized for visualizing an electrostatic latent image (development).

In such triboelectric charging, it is necessary that the surfaces of the toner particles be charged either positively or negatively depending upon the type of a photoconductor used for forming thereon an electrostatic latent image and that the amount of the toner charge be made sufficient to more precisely visualize an electrostatic latent image. For this reason, a charge control agent or an electrically conductive material is usually mixed with and dispersed in the binder.

Heretofore, metal-complex-salt-containing dyes as disclosed in Japanese Patent Publication No. 26478/1970 and the like have been generally used as charge control agents so that toner particles can be negatively charged. However, such metal-complex-salt-containing dyes are of complicated structure and have unstable properties. Therefore, they are affected thermally or mechanically during the step of melt kneading or grinding in the production of a toner, and readily undergo decomposition or deterioration. Their charge-controlling properties are thus impaired, and the resulting toner is to have drastically deteriorated properties.

Further, the metal-complex-salt-containing dyes have low compatibility with thermoplastic resins which are used as binders, so that they can exist in the binders only in such a state that their particles are being dispersed in the binders, just like coloring agents. For this reason, the charge control agent existing on the surface layers of the toner particles falls during the step of grinding in the production of the toner, or due to fluid friction caused in a copying machine when charge is accumulated on the surfaces of the toner particles. As a result, the amount of the toner charge is changed, and the toner particles have different amounts of charge. It is thus difficult to stably maintain the toner in a charged state for a long period of time. Furthermore, the metal-complex-salt-containing dyes are, in general, colored, and poor in transparency. Therefore, even if the toner is made into a color toner in a desired color so as to meet the trend toward color duplication, a colored image cannot be clearly obtained by using such a color toner.

In order to improve the aforementioned shortcomings of the metal-complex-salt-containing dyes to be used as the charge control agents, we previously invented a toner for electrophotography to be charged negatively which comprises as a negative charge control agent a copolymer obtained by copolymerizing a polymerizable compound having negative-charge-controlling properties with a polymerizable vinyl monomer copolymerizable therewith, dispersed in a binder, and made an application for patent (Japanese Laid-Open Patent Publications Nos. 184762/1988 and 56974/1991).

Since the above-described copolymer-type negative charge control agent is highly compatible with a synthetic resin which serves as the binder, it does not bring about, unlike the metal-complex-salt-containing dyes, such a problem that the amount of toner charge is changed or diversified due to the falling of the charge control agent. In addition, in order to meet the trend toward color duplication, the toner comprising this charge control agent can be made into a color toner which can clearly produce an image in a desired color. However, since acrylamide methylpropanesulfonic acid is used as the polymerizable compound having negative-charge-controlling properties, the toner properties are impaired at high temperatures and high humidities; in particular, a decrease in the amount of the toner charge is relatively large. Therefore, there is such a problem that it is difficult for the toner to stably produce a clear image over a long period of time.

DISCLOSURE OF THE INVENTION

An object of the present invention is to solve the aforementioned problems in the conventional toners for electrophotography to be negatively charged. We have made studies in order to provide a toner for electrophotopraphy to be negatively charged which is excellent in both the properties of being charged immediately and the stability thereof, which can form a good image that is free from toner scattering, fogging and the like, and of which properties are not impaired even at high temperatures and high humidities. As a result, it was found that the above object can be attained when a copolymer obtainable by copolymerizing a sulfoalkyl (meth)acrylic acid monomer having a specific chemical formula with a vinyl monomer copolymerizable therewith is used as the charge control agent. The present invention has been accomplished on the basis of the above finding.

A negatively charged toner for electrophotography provided by the present invention is one which comprises a binder, a coloring agent and a charge control agent, the charge control agent comprising a copolymer of 1 to 30% by weight of a sulfoalkyl (meth)acrylic acid monomer represented by the following general formula (1):

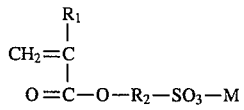

(1)

wherein $R_1$ represents H or $CH_3$, $R_2$ represents $C_2H_4$ or $C_3H_6$, and M represents one selected from H, Na, K and $NH_4$, or by the following general formula (2):

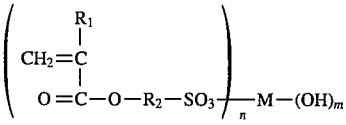

(2)

wherein $R_1$ represents H or $CH_3$, $R_2$ represents $C_2H_4$ or $C_3H_6$, M represents Ca or Mg, n is 1 or 2, and m is 2–n, and 99 to 70% by weight of other vinyl monomer copolymerizable with the monomer (1) or (2), the amount of the charge control agent being from 0.1 to 10 parts by weight for 100 parts by weight of the binder.

BEST MODE FOR CARRYING OUT THE INVENTION

The above toner for electrophotography according to the present invention (hereinafter referred to as the toner of the present invention) is characterized in that a copolymer of 1 to 30% by weight of a sulfoalkyl (meth)acrylic acid monomer represented by the above general formula (1) or (2) and 99 to 70% by weight of other vinyl monomer copolymerizable therewith is used as the negative charge control agent. In this copolymer, when the proportion of the sulfoalkyl (meth)acrylic acid monomer copolymerized is less than 1% by weight, it is difficult to accumulate a sufficient amount of charge on the toner. Therefore, the toner tends to scatter, and is thus unsuitable for practical use. On the other hand, when the proportion of the sulfoalkyl (meth)acrylic acid monomer copolymerized is more than 30% by weight, the electrical resistance of the resulting toner is low, so that the amount of the toner charge is unstably changed with time. In addition, such a copolymer cannot have high compatibility with the binder, so that the resulting toner is poor in transparency. In this copolymer, the proportion of the sulfoalkyl (meth-)acrylic acid monomer is preferably from 2 to 20% by weight, and that of the vinyl monomer copolymerizable therewith is preferably from 98 to 80% by weight.

Specific examples of the sulfoalkyl (meth)acrylic acid monomer represented by the above general formula (1), usefulforthe present invention include sulfoethyl acrylic acid, sulfoethyl methacrylic acid, sodium sulfoethyl acrylate, sodium sulfoethyl methacrylate, ammonium sulfoethyl acrylate, ammonium sulfoethyl methacrylate, potassium sulfoethyl acrylate, potassium sulfoethyl methacrylate, potassium sulfopropyl acrylate and potassium sulfopropyl methacrylate. Specific examples of the sulfoalkyl (meth)acrylic acid monomer represented by the above general formula (2) include calcium sulfoethyl acrylate, calcium sulfoethyl methacrylate, magnesium sulfoethyl acrylate and magnesium sulfoethyl methacrylate. These monomers can be used either singly or in combination of two or more.

Among the above-enumerated sulfoalkyl (meth)acrylic acid monomers, at least one monomer selected from sodium sulfoethyl acrylate, sodium sulfoethyl methacrylate, ammonium sulfoethyl acrylate, ammonium sulfoethyl methacrylate, potassium sulfopropyl acrylate and potassium sulfopropyl methacrylate is preferably used. This is because such a monomer is readily copolymerizable and because a copolymer having favorable softness as a component of a toner for electrophotography tends to be obtained.

There is no particular limitation on the vinyl monomer which is copolymerized with the above-described sulfoalkyl (meth)acrylic acid monomer, and any vinyl monomer having a polymerizable unsaturated bond can be used. Specific examples of the vinyl monomer include styrene, o-, m- and p-chlorostyrenes, alpha-methylstyrene, vinyltoluene, (meth-)acrylic acid, maleic acid, iraconic acid, methyl (meth)acrylate, ethyl (meth)acrylate, propyl (meth)acrylate, butyl (meth)acrylate, 2-ethylhexyl (meth)acrylate, amyl (meth-)acrylate, cyclohexyl (meth)acrylate, lauryl (meth)acrylate, stearyl (meth)acrylate, behenyl (meth)acrylate, acrylamide, vinyl chloride and vinyl acetate. Among these vinyl monomers, at least one monomer selected from styrene and the alkyl (meth)acrylates is preferably used. Those alkyl (meth-)acrylates whose alkyl group contains 1 to 18 carbon atoms are preferred as the alkyl (meth)acrylates.

In the present invention, it is particularly preferable to use as the charge control agent a copolymer which can be obtained by copolymerizing at least one compound selected from ammonium sulfoethyl methacrylate, sodium sulfoethyl methacrylate and potassium sulfopropyl methacrylate as the above-described sulfoalkyl (meth)acrylic acid monomer with at least one monomer selected from styrene and the alkyl (meth)acrylates as the vinyl monomer. This is because such a copolymer is highly compatible with the-binder and can remain transparent when incorporated into the binder and because the properties of the toner comprising the copolymer can be stably maintained even under severe conditions such as high temperatures and high humidities.

There is no particular limitation on the method for preparing the copolymer of the above-described sulfoalkyl (meth)acrylic acid monomer and the vinyl monomer copolymerizable therewith, which is the charge control agent for use in the toner of the present invention, and any known radical polymerization method can be adopted. Specifically, solution, emulsion, suspension or bulk polymerization method can be employed. Of these, solution polymerization method, in which polymerization reaction is carried out in an organic solvent in the presence of a suitable polymerization initiator, is particularly preferred. There is no particular limitation even on the polymerization initiator, and any known initiator (for example, benzoyl peroxide, tert-butyl perbenzoate, dicyclohexyl peroxide, dicumyl peroxide, azobisisobutylonitrile, azobismethylbutylonitrile and azobisdimethylvaleronitrile) usually used in radical polymerization reaction can be used.

There is no particular limitation on the molecular weight, the glass transition temperature and the like of the above-described copolymer for use in the toner of the present invention. It is however preferable that the weight-average molecular weight (hereinafter referred to as Mw) and the glass transition temperature (hereinafter referred to as Tg) of the copolymer be in the range of 5,000 to 500,000, and in the range of 30° to 100° C., respectively. This is because such a copolymer can remain transparent when incorporated into the binder and because the copolymer acts so that the finally-obtainable toner can maintain both excellent preservation stability and the properties of being charged for a long period of time.

Any of various synthetic resins which have been used as binders in the conventional toners for electrophotography can be used as the binder in the toner of the present invention. Specific examples of the binder include a homopolymer of polystyrene or (meth)acrylate, a copolymer resin of polystyrene and (meth)acrylate, and a polyester resin synthesized by using at least one diol component selected from the group consisting of bisphenol-type diols and glycols, and a dicarboxylic acid such as phthalic acid, isophthalic acid or terephthalic acid, or trimellitic acid.

In the toner of the present invention, the amount of the above charge control agent to be used is from 0.1 to 10 parts by weight for 100 parts by weight of the binder. When the amount of the charge control agent is less than 0.1 parts by weight, the toner cannot be charged immediately. In addition, the toner tends to scatter, or to deposit undesirably. On the other hand, when the amount of the charge control agent is in excess of 10 parts by weight, the toner has high hygroscopicity, so that the amount of the toner charge is greatly changed with time.

In the toner of the present invention, various known coloring agents such as organic pigments, inorganic pigments, extender pigments and dyes which have been conventionally used can be used in order to obtain toner particles in a desired color. Specific examples of the coloring agent which can be used in the present invention include pigments such as black pigments (carbon black, acetylene black, lamp black, etc.), yellow pigments (zinc yellow, yellow iron oxide, mineral fast yellow, navel yellow, Hansa yellow, benzidine yellow, permanent yellow, etc.), red pigments (red oxide, cadmium red, permanent red, lake red, brilliant carmine, etc.), blue pigments (Prussian blue, cobalt blue, phthalocyanine blue, fast sky blue, indanthrene blue, etc.), green pigments (chrome green, malachite green lake, etc.) white pigments (zinc white, titanium oxide, etc.) and extender pigments (barium carbonate, clay, silica, talc, alumina white, etc.); and dyes such as benzidine yellow, Hansa yellow and chromophthal yellow. These coloring agents can be used either singly or in combination of two or more.

The toner of the present invention can be prepared by any one of various known methods. Examples of the method include a method in which the above-described binder, charge control agent and coloring agent in predetermined amounts, and, when necessary, various additives for use in toners in conventional amounts are mixed, and the mixture is subjected to melt kneading, grinding, and then classification to obtain particles with an average particle diameter of 5 to 20 micrometers; a method in which the starting materials (the charge control agent, the coloring agent, etc.) other than the principal resin is dispersed in a monomer which will yield the principal resin, and the monomer is polymerized to obtain toner particles into which the starting materials are incorporated; and a method in which the components of the toner are dissolved or dispersed in a suitable organic solvent, and the solution or dispersion is subjected to granulation, using such an apparatus as a spray drier.

The toner of the present invention can be used as a two-component developer, for example, by being blended with a suitable carrier. Glass beads or steel spheres coated with a resin are used as the carrier in the case where cascade development is conducted. A ferrite or extremely-fine iron powder, or a so-called binder-type carrier is used when magnetic brush development is conducted. Alternatively, the toner of the present invention is prepared as an insulating magnetic toner, and magnetic brush development may be conducted by using the toner as a single-component developer. Further, the toner of the present invention may be used as a toner for impression development.

The present invention has been explained in terms of the toner for electrophotography to be charged negatively. However, the charge control agent for use in the present invention itself is a copolymer having unique electrical properties. Therefore, the copolymer can be used not only as the charge control agent but also for many other purposes in which the electrical properties can be utilized. For instance, the copolymer may be used as a surface-coating agent for a carrier for electrophotography, or as a resin binder for a powder coating. In this case, the copolymer is used either singly, or as a mixture with any other suitable rein.

The present invention will now be explained more specifically by referring to the following Examples, which should not be construed as limiting the present invention. It is noted that throughout the examples, copolymerization ratios and mixing ratios are based on weight, unless otherwise indicated.

EXAMPLE 1

Preparation of Charge Control Agent

In a 2-liter flask equipped with a stirrer, a condenser, a thermometer and a nitrogen-introducing tube, 300 g of methanol and 100 g of methyl ethyl ketone were charged. To this mixture were further added 600 g of a monomer mixture consisting of 5 parts of ammonium sulfoethyl methacrylate, 85 parts of styrene and 10 parts of 2-ethylhexyl acrylate, and 12 g of azobisisobutylonitrile. Solution polymerization was conducted with stirring under nitrogen at 70° C. for 10 hours. After the polymerization reaction was completed, the reaction mixture was placed in a vacuum heating oven to evaporate the methanol and the methyl ethyl ketone, thereby obtaining a copolymer (weight-average molecular weight= 40,000, Tg=70° C.) to be used as the charge control agent.

Production of Toner 100 parts of a styrene-acryl copolymer resin, 5 parts of the above-obtained charge control agent, 5 parts of carbon black ("MA#100" manufactured by Mitsubishi Chemical Industries, Ltd.) and 3 parts of "Biscol 550P" (manufactured by Sanyo Chemical Industries, Ltd.) were mixed, and melt-kneaded in a Labo-plastomill (manufactured by Toyo Seiki Seisakusho, Ltd.). The mixture was pulverized by a jet mill, and then subjected to classification to obtain toner particles having an average particle diameter of 10 micrometers.

Evaluation of Toner

The above-obtained toner was evaluated by the following methods. The results are shown in below Table 1.

(1) Properties of Being Charged

The toner and a carrier (a reduced iron powder) were mixed with each other in a mixing ratio of 3:100. The mixture was triboelectrically charged under the conditions of 20° C. and 65% RH for a predetermined time (10 minutes, 60 minutes or 3 hours), and the amount of the toner charge (-microcoulomb/gram) was measured by a blow-off-type apparatus for measuring the amount of charge on a powder, manufactured by Toshiba Chemical Corporation.

(2) Properties at High Temperatures and High Humidities

The toner and a carrier (a reduced iron powder) were mixed with each other in a mixing ratio of 3:100 as described in the above (1). The mixture was triboelectrically charged at a high temperature of 35° C. and a high humidity of 85% RH for 60 minutes, and the amount of the toner charge (-microcoulomb/gram), C1, was measured in the same manner as in the above procedure. When the amount of the charge accumulated on the toner by the 60-minute triboelectric charging conducted in the above (1) is indicated by C0, the charge-remaining rate (%) can be obtained by the following equation:

$$\text{Charge-Remaining Rate } (\%)=(C1/C0)\times 100.$$

A toner having a charge-remaining rate of 90% or more is considered as good in the properties at high temperatures and high humidities.

(3) Electrophotographic Properties

By using the above-obtained toner and a commercially available copying machine for use with a toner to be negatively charged, a duplication test was carried out. Fogging, and stain on the photoconductor were visually observed, and evaluated in accordance with the following standards:

Fogging:

O: No fogging was caused.

X: The background was stained.

Stain on Photoconductor:

O: Not stained.

X: Deposited with the toner.

EXAMPLES 2 TO 11 & COMPARATIVE EXAMPLES 1 TO 7

Charge control agents were respectively prepared in substantially the same manner as in Example 1 by using, as the sulfoalkyl (meth)acrylic acid monomer, ammonium sulfoethyl methacrylate (SEMA), sodium sulfoethyl methacrylate (SEMS), potassium sulfopropyl methacrylate (SPMK), potassium sulfopropyl acrylate (SPAK), calcium disulfoethyl acrylate (DSAC) or hydroxycalcium sulfoethyl acrylate (SAHC), and, as the vinyl monomer copolymerizable therewith, styrene, 2-ethylhexyl acrylate (2EHA) or butyl acrylate (BA), or using, as the negative charge control compound, acrylamide methylpropanesulfonic acid (AAPS) for comparison, in accordance with the formulations shown in below Tables 1 to 3 (Examples 2 to 6 in Table 1, Examples 7 to 11 and Comparative Example 1 in Table 2, and Comparative Examples 2 to 7 in Table 3).

Successively, each of the above-obtained charge control agents was added to 100 parts by weight of the binder in accordance with the formulation shown in Table 1, 2 or 3, and the mixtures were treated in the same manner as in Example 1 to obtain toners. The toners thus obtained were respectively evaluated in the same manner as in Example 1. The results are shown in Tables 1 to 3. Further, the Mw and Tg of each of the charge control agents of Examples and Comparative Examples were determined. The results are also shown in the tables.

TABLE 1

| | | Example | | | | | |
|---|---|---|---|---|---|---|---|
| | | 1 | 2 | 3 | 4 | 5 | 6 |
| Formulation of Charge Control Agent | Styrene | (85) | 80 | 65 | 80 | 75 | 80 |
| | 2EHA | (10) | 10 | 10 | — | 15 | — |
| | BA | — | — | — | 10 | — | 15 |
| | SEMA | (5) | 10 | 25 | 10 | — | — |
| | SEMS | — | — | — | — | 10 | 5 |
| | SPMK | — | — | — | — | — | — |
| | SPAK | — | — | — | — | — | — |
| | DSAC | — | — | — | — | — | — |
| | SAHC | — | — | — | — | — | — |
| | AAPS | — | — | — | — | — | — |
| Mw of Charge Control Agent | | (40,000) | 51,000 | 23,000 | 12,000 | 13,000 | 10,000 |
| Tg(°C.) of Charge Control Agent | | (70) | 72 | 70 | 68 | 62 | 63 |
| Amount of Charge Control Agent Added | | (5) | 5 | 2 | 3 | 3 | 7 |
| Evaluation Items | Amount of Charge (μc/g) (10 min.) | 20.4 | 31.2 | 28.3 | 22.8 | 21.9 | 23.6 |
| | (60 min.) | 22.7 | 33.8 | 30.1 | 24.2 | 23.5 | 25.1 |
| | (3 hrs.) | 24.0 | 35.1 | 31.7 | 25.3 | 24.7 | 26.6 |
| | Properties at High Temperatures and High Humidities (%) | 100 | 100 | 98 | 100 | 99 | 98 |
| | Electrophotographic Properties (Fogging) | O | O | O | O | O | O |
| | (Stain on Photoconductor) | O | O | O | O | O | O |

TABLE 2

| | | Example | | | | | Comparative Example |
|---|---|---|---|---|---|---|---|
| | | 7 | 8 | 9 | 10 | 11 | 6 |
| Formulation of Charge Control Agent | Styrene | 70 | 80 | 75 | 80 | 80 | 50 |
| | 2EHA | — | 15 | — | — | — | 10 |
| | BA | 15 | — | 20 | 15 | 15 | — |
| | SEMA | — | — | — | — | — | 40 |
| | SEMS | — | — | — | — | — | — |
| | SPMK | 15 | — | 5 | — | — | — |
| | SPAK | — | 5 | — | — | — | — |
| | DSAC | — | — | — | 5 | — | — |
| | SAHC | — | — | — | — | 5 | — |

TABLE 2-continued

| | | Example | | | | | Comparative Example |
|---|---|---|---|---|---|---|---|
| | | 7 | 8 | 9 | 10 | 11 | 6 |
| | AAPS | — | — | — | — | — | — |
| Mw of Charge Control Agent | | 15,000 | 21,000 | 12,000 | 39,000 | 11,000 | 31,000 |
| Tg(°C.) of Charge Control Agent | | 65 | 62 | 59 | 70 | 63 | 75 |
| Amount of Charge Control Agent Added | | 3 | 5 | 3 | 5 | 3 | 3 |
| Evaluation Items | Amount of Charge (μc/g) (10 min.) | 25.3 | 18.5 | 16.4 | 16.8 | 15.1 | 34.1 |
| | (60 min.) | 27.9 | 20.1 | 18.0 | 18.5 | 17.5 | 35.3 |
| | (3 hrs.) | 28.2 | 20.4 | 18.2 | 18.9 | 17.8 | 32.6 |
| | Properties at High Temperatures and High Humidities (%) | 99 | 100 | 100 | 99 | 100 | 66 |
| | Electrophotographic Properties (Fogging) | ○ | ○ | ○ | ○ | ○ | ○ |
| | (Stain on Photoconductor) | ○ | ○ | ○ | ○ | ○ | ○ |

TABLE 3

| | | Comparative Example | | | | | |
|---|---|---|---|---|---|---|---|
| | | 2 | 3 | 4 | 5 | 6 | 7 |
| Formulation of Charge Control Agent | Styrene | 89.5 | 80 | 80 | 80 | 50 | 80 |
| | 2EHA | 10 | 10 | 10 | — | — | — |
| | BA | — | — | — | 10 | 10 | 10 |
| | SEMA | 0.5 | — | 10 | — | — | — |
| | SEMS | — | — | — | 10 | — | — |
| | SPMK | — | — | — | — | 40 | — |
| | SPAK | — | 10 | — | — | — | — |
| | DSAC | — | — | — | — | — | — |
| | SAHC | — | — | — | — | — | — |
| | AAPS | — | — | — | — | — | 10 |
| Mw of Charge Control Agent | | 15,000 | 12,000 | 17,000 | 10,000 | 13,000 | 12,000 |
| Tg(°C.) of Charge Control Agent | | 67 | 70 | 71 | 70 | 73 | 70 |
| Amount of Charge Control Agent Added | | 10 | 15 | 0.05 | 12 | 3 | 3 |
| Evaluation Items | Amount of Charge (μc/g) (10 min.) | 8.2 | 41.2 | 4.7 | 37.6 | 35.6 | 20.3 |
| | (60 min.) | 9.0 | 45.5 | 6.3 | 41.3 | 36.3 | 22.1 |
| | (3 hrs.) | 9.2 | 37.3 | 7.5 | 39.5 | 33.1 | 22.9 |
| | Properties at High Temperatures and High Humidities (%) | 95 | 72 | 96 | 74 | 63 | 85 |
| | Electrophotographic Properties (Fogging) | x | ○ | x | ○ | ○ | ○ |
| | (Stain on Photoconductor) | x | ○ | x | ○ | ○ | ○ |

The toner for electrophotography to be charged negatively provided by the present invention comprises as the charge control agent a specific proportion of a copolymer of a sulfoalkyl (meth)acrylic acid monomer having a specific chemical formula and a vinyl monomer copolymerizable therewith.

Therefore, the properties of being negatively charged can be stably obtained, and the amount of the toner charge is not greatly changed by a change in the environmental conditions. The toner of the present invention thus has excellent electrophotographic properties.

Further, when the negative charge control agent is mixed with a binder, the mixture can remain in a colorless or light-colored, transparent state. Therefore, the toner comprising such a charge control agent can be made into a color toner which can clearly produce a colored image.

What is claimed is:

1. A negatively chargable toner for electrophotography, comprising a binder, a coloring agent and a charge control agent, the charge control agent comprising a copolymer of 1 to 30% by weight of a sulfoalkyl (meth)acrylic acid monomer represented by the following general formula (1) or (2):

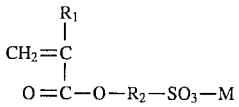

(1)

wherein $R_1$ represents H or $CH_3$, $R_2$ represents $C_2H_4$ or $C_3H_6$, and M represents one selected from H, Na, K and $NH_4$,

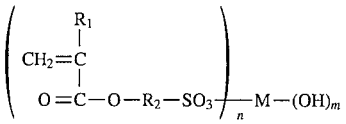

(2)

wherein $R_2$ represents H or $CH_3$, $R_2$ represents $C_2H_4$ or $C_3H_6$, M represents Ca or Mg, n is 1 or 2, and m is 2–n, and 99 to 70% by weight of other vinyl monomer which is copolymerizable with said monomer (1) or (2), the amount of the charge control agent being from 0.1 to 10 parts by weight for 100 parts by weight of the binder.

2. The negatively chargable toner according to claim 1, wherein the sulfoalkyl (meth)acrylic acid monomer represented by the general formula (1) or (2) is at least one monomer selected from sodium sulfoethyl acrylate, sodium sulfoethyl methacrylate, ammonium sulfoethyl acrylate, ammonium sulfoethyl methacrylate, potassium sulfopropyl acrylate and potassium sulfopropyl methacrylate.

3. The negatively chargable toner according to claim 1, wherein the vinyl monomer copolymerizable with the sulfoalkyl (meth)acrylic acid monomer is at least one monomer selected from styrene, alkyl acrylates and alkyl methacrylates.

4. The negatively chargable toner according to claim 3, wherein the alkyl acrylates and the alkyl methacrylates are alkyl esters whose alkyl group contains 1 to 18 carbon atoms.

* * * * *